US009889349B1

(12) United States Patent
Seluga et al.

(10) Patent No.: US 9,889,349 B1
(45) Date of Patent: Feb. 13, 2018

(54) GOLF CLUB HEAD HAVING STRESS-REDUCING STRUCTURES

(71) Applicant: Callaway Golf Company, Carlsbad, CA (US)

(72) Inventors: James A. Seluga, Carlsbad, CA (US); Matthew Myers, Carlsbad, CA (US); Patrick Dawson, San Diego, CA (US)

(73) Assignee: Callway Golf Company, Carlsbad, CA (US)

( * ) Notice: Subject to any disclaimer, the term of this patent is extended or adjusted under 35 U.S.C. 154(b) by 0 days.

(21) Appl. No.: 15/167,588

(22) Filed: May 27, 2016

Related U.S. Application Data

(63) Continuation-in-part of application No. 14/713,090, filed on May 15, 2015, now Pat. No. 9,352,199, which is a continuation of application No. 14/159,262, filed on Jan. 20, 2014, now Pat. No. 9,067,110, said application No. 15/167,588 is a continuation-in-part of application No. 15/051,361, filed on Feb. 23, 2016, now Pat. No. 9,757,629, which is a continuation-in-part of application No.

(Continued)

(51) Int. Cl.
*A63B 53/04* (2015.01)
*A63B 53/06* (2015.01)

(52) U.S. Cl.
CPC .. *A63B 53/0466* (2013.01); *A63B 2053/0454* (2013.01)

(58) Field of Classification Search
CPC ..... A63B 53/0466; A63B 2053/0437; A63B 2053/0433; A63B 2053/045; A63B 2053/0408; A63B 2053/0412
USPC ..... 473/287–292, 324–350
See application file for complete search history.

(56) References Cited

U.S. PATENT DOCUMENTS 3,652,094 A 3/1972 Glover
4,775,156 A * 10/1988 Thompson ..... A63B 53/04 473/328

(Continued)

FOREIGN PATENT DOCUMENTS

JP 01043278 2/1989
JP 3821516 9/2006
JP 2007267777 10/2007

OTHER PUBLICATIONS

Non-Final Office Action dated Apr. 20, 2017, U.S. Appl. No. 15/279,188.

(Continued)

*Primary Examiner* — William Pierce
(74) *Attorney, Agent, or Firm* — Rebecca Hanovice; Michael Catania; Sonia Lari

(57) ABSTRACT

A golf club head comprising a body and a plurality of stiffening members is disclosed herein. The body comprises a face section, a sole section, and a crown section or a return section, and also defines a hollow interior. Each of the plurality of stiffening members extends from the crown section or return section to the sole section to reduce stresses placed on the face during impact with a golf ball. The stiffening members preferably are preloaded, and may be tightened using a tool. Each of the stiffening members has a midsection that is preferably selected from the group consisting of a solid metal rod, a hollow metal tube, and a spring, and each preferably is composed of a titanium alloy.

7 Claims, 10 Drawing Sheets

Related U.S. Application Data

14/997,199, filed on Jan. 15, 2016, which is a continuation-in-part of application No. 14/788,326, filed on Jun. 30, 2015, now Pat. No. 9,597,558, and a continuation-in-part of application No. 14/622,606, filed on Feb. 13, 2015, now Pat. No. 9,345,936, which is a continuation of application No. 13/906,572, filed on May 31, 2013, now Pat. No. 8,956,244, said application No. 14/997,199 is a continuation-in-part of application No. 14/794,578, filed on Jul. 8, 2015, now Pat. No. 9,814,947, which is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/684,079, filed on Aug. 16, 2012, provisional application No. 61/665,203, filed on Jun. 27, 2012, provisional application No. 61/886,473, filed on Oct. 3, 2013.

(56) References Cited

U.S. PATENT DOCUMENTS

| | | | | |
|---|---|---|---|---|
| 5,429,365 | A * | 7/1995 | McKeighen | A63B 53/04 164/45 |
| 5,489,097 | A | 2/1996 | Simmons | |
| 5,766,094 | A | 6/1998 | Mahaffey et al. | |
| 6,149,533 | A | 11/2000 | Finn | |
| 6,299,547 | B1 | 10/2001 | Kosmatka | |
| 6,332,847 | B2 | 12/2001 | Murphy et al. | |
| 6,383,090 | B1 | 5/2002 | O'Doherty et al. | |
| 6,435,978 | B1 | 8/2002 | Galloway et al. | |
| 6,475,100 | B1 | 11/2002 | Helmstetter et al. | |
| 6,524,197 | B2 * | 2/2003 | Boone | A63B 53/0466 473/324 |
| 6,835,145 | B2 | 12/2004 | Tsurumaki | |
| 6,852,038 | B2 | 2/2005 | Yabu | |
| 6,923,734 | B2 | 8/2005 | Meyer | |
| 6,979,270 | B1 | 12/2005 | Allen | |
| 7,066,835 | B2 | 6/2006 | Evans et al. | |
| 7,108,609 | B2 | 9/2006 | Stites et al. | |
| 7,118,493 | B2 | 10/2006 | Galloway | |
| 7,166,041 | B2 | 1/2007 | Evans | |
| 7,351,161 | B2 | 4/2008 | Beach | |
| 7,387,579 | B2 | 6/2008 | Lin et al. | |
| 7,445,563 | B1 | 11/2008 | Werner | |
| 7,691,006 | B1 | 4/2010 | Burke | |
| 7,775,905 | B2 | 8/2010 | Beach et al. | |
| 7,914,393 | B2 | 3/2011 | Hirsch et al. | |
| 7,927,231 | B2 | 4/2011 | Sato et al. | |
| 8,523,702 | B2 | 9/2013 | Thomas et al. | |
| 8,540,587 | B2 | 9/2013 | Hirsch et al. | |
| 8,591,352 | B2 | 11/2013 | Hirano | |
| 8,608,585 | B2 | 12/2013 | Stites et al. | |
| 8,663,027 | B2 | 3/2014 | Morales et al. | |
| 8,834,293 | B2 * | 9/2014 | Thomas | A63B 53/0466 473/332 |
| 8,834,294 | B1 * | 9/2014 | Seluga | A63B 53/04 473/338 |
| 8,888,607 | B2 * | 11/2014 | Harbert | A63B 53/04 473/307 |
| 8,956,244 | B1 * | 2/2015 | Westrum | 473/338 |
| 9,067,110 | B1 * | 6/2015 | Seluga | A63B 53/06 |
| 9,079,078 | B2 | 7/2015 | Greensmith et al. | |
| 9,220,953 | B2 * | 12/2015 | Beach | A63B 53/04 |
| 9,486,677 | B1 * | 11/2016 | Seluga | A63B 53/0466 |
| 9,597,558 | B1 * | 3/2017 | Seluga | A63B 53/0466 |
| 9,597,561 | B1 * | 3/2017 | Seluga | A63B 53/0466 |
| 2010/0273565 | A1 | 10/2010 | Stites et al. | |
| 2010/0304887 | A1 | 12/2010 | Bennett et al. | |
| 2010/0331101 | A1 | 12/2010 | Sato et al. | |
| 2011/0039634 | A1 | 2/2011 | Tavares et al. | |
| 2011/0152001 | A1 | 6/2011 | Hirano | |
| 2011/0172027 | A1 | 7/2011 | Hirsch et al. | |
| 2011/0224017 | A1 | 9/2011 | Thomas et al. | |
| 2012/0094780 | A1 | 4/2012 | Slaughter et al. | |
| 2012/0165115 | A1 | 6/2012 | Matsunaga | |
| 2012/0289360 | A1 | 11/2012 | Breier et al. | |
| 2012/0302367 | A1 | 11/2012 | Myrhum et al. | |
| 2013/0102410 | A1 | 4/2013 | Stites et al. | |
| 2013/0130829 | A1 | 5/2013 | Bennett et al. | |
| 2013/0130834 | A1 | 5/2013 | Stites et al. | |
| 2013/0184099 | A1 | 7/2013 | Stites et al. | |
| 2013/0324299 | A1 | 12/2013 | Clausen et al. | |
| 2015/0165280 | A1 | 6/2015 | Hebreo | |

OTHER PUBLICATIONS

Final Office Action dated Feb. 21, 2017, U.S. Appl. No. 14/794,578.
Final Office Action dated Feb. 21, 2017, U.S. Appl. No. 14/997,199.
Final Office Action dated Mar. 24, 2017, U.S. Appl. No. 15/063,107.
Non-Final Office Action dated Jun. 28, 2016, U.S. Appl. No. 15/013,052.
Non-Final Office Action dated Jun. 29, 2016, U.S. Appl. No. 14/794,578.
Non-Final Office Action dated Apr. 21, 2016, U.S. Appl. No. 14/794,578.
Non-Final Office Action dated Jan. 14, 2016, U.S. Appl. No. 14/794,578.
Non-Final Office Action dated Jun. 28, 2016, U.S. Appl. No. 15/011,313.
Non-Final Office Action dated Jul. 12, 2016, U.S. Appl. No. 14/997,199.
Non-Final Office Action dated Jul. 11, 2016, U.S. Appl. No. 15/063,107.
Non-Final Office Action dated Jul. 22, 2016, U.S. Appl. No. 15/051,361.
Non-Final Office Action dated Dec. 1, 2016, U.S. Appl. No. 15/005,875.
Non-Final Office Action dated Apr. 17, 2017, U.S. Appl. No. 15/447,638.
Non-Final Office Action dated Apr. 17, 2017, U.S. Appl. No. 15/446,754.
Non-Final Office Action dated Sep. 8, 2016, U.S. Appl. No. 14/847,227.
Non-Final Office Action dated Feb. 23, 2017, U.S. Appl. No. 15/385,549.

* cited by examiner

GOLF CLUB HEAD HAVING STRESS-REDUCING STRUCTURES

CROSS REFERENCES TO RELATED APPLICATIONS

The present invention is a continuation-in-part of U.S. patent application Ser. No. 15/051,361, filed on Feb. 23, 2016, which is a continuation-in-part of U.S. patent application Ser. No. 14/997,199, filed on Jan. 15, 2016, which is a continuation-in-part of U.S. patent application Ser. No. 14/788,326, filed on Jun. 30, 2015, and is also a continuation-in-part of U.S. patent application Ser. No. 14/794,578, filed on Jul. 8, 2015, and is also a continuation-in-part of U.S. patent application Ser. No. 14/622,606, filed on Feb. 13, 2015, and issued on May 24, 2016, as U.S. Pat. No. 9,345,936, which is a continuation of U.S. patent application Ser. No. 13/906,572, filed on May 31, 2013, and issued on Feb. 17, 2015, as U.S. Pat. No. 8,956,244, the disclosure of each of which is hereby incorporated by reference in its entirety herein. The present invention is also a continuation-in-part of U.S. patent application Ser. No. 14/713,090, filed on May 15, 2015, and issued on May 31, 2016, as U.S. Pat. No. 9,352,199, which is a continuation of U.S. patent application Ser. No. 14/159,262, filed on Jan. 20, 2014, and issued on Jun. 30, 2015, as U.S. Pat. No. 9,067,110, which claims priority to U.S. Provisional Patent Application No. 61/886,473, filed on Oct. 3, 2013, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with stress-reducing stiffening members disposed proximate a striking face and composed of a high-strength material such as titanium alloy.

Description of the Related Art

The prior art discloses various golf club heads having interior structures. For example, Yabu, U.S. Pat. No. 6,852,038 for a Golf Club Head And Method OF Making The Same, discloses a golf club head with a sound bar, Galloway, U.S. Pat. No. 7,118,493 for a Multiple Material Golf Club Head discloses a golf club head with a composite aft body having an interior sound component extending upward from a sole section of a metal face component, Seluga et al., U.S. Pat. No. 8,834,294 for a Golf Club Head With Center Of Gravity Adjustability discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the face at impact, with a minimal increase in mass to the golf club head.

BRIEF SUMMARY OF THE INVENTION

The golf club head comprises a plurality of interior structures located proximate a rear surface of a striking face to reduce the stress in the face during impact with a golf ball. In a preferred embodiment, the structures are stiffening members that can be tightened or loosened by a golfer to adjust the stresses placed on the golf club head, and particularly its striking face.

One aspect of the present invention is a golf club head comprising a body comprising a striking face, a sole section, and a crown section, the body defining a hollow interior, and at least one stiffening member extending from the crown section to the sole section through the hollow interior, wherein the striking face comprises a face center and an interior surface facing the hollow interior, wherein the at least one stiffening member is disposed within 0.500 inch of the interior surface along a vertical plane extending through the face center perpendicular to the striking face, and wherein when the striking face makes contact with a golf ball traveling at approximately 100 mph, the at least one stiffening member comprises a first load value, the striking face comprises a second load value, and the first load value is at least 30% of the second load value. In some embodiments, the first load value may be at least 45% of the second load value. In other embodiments, the first load value may be at least 1250 lbf and the second load value may be at least 2750 lbf. In still other embodiments, the at least one stiffening member may comprise first, second, and third stiffening members, and may be preloaded at 125 lbf to 1000 lbf.

In some embodiments, the at least one stiffening member may comprise a midsection with a structure selected from the group consisting of a solid rod, a hollow tube, and a spring. In a further embodiment, the midsection may have a diameter ranging from 0.050 inch to 0.200 inch. In other embodiments, the at least one stiffening member may have a length ranging from 1 inch to 2.5 inches, and may be composed of a metal alloy, which may be selected from the group consisting of steel and titanium alloy. In any of the embodiments disclosed herein, the golf club head may be selected from the group consisting of a putter-type head, an iron-type head, a wedge-type head, a hybrid-type head, a fairway wood-type head, and a driver-type head.

Another aspect of the present invention is a golf club head comprising a body comprising a striking face, a sole section and a crown section, the body defining a hollow interior, at least one first boss comprising a bore with a first plurality of threads, at least one second boss comprising a bore with a ledge, and at least one stiffening member extending from the crown section to the sole section through the hollow interior, wherein the at least one stiffening member comprises a head portion, an end portion comprising a second plurality of threads, and a midsection connecting the head portion to the end portion, wherein the at least one stiffening member is at least partially composed of a metal alloy, wherein the crown section comprises at least one crown aperture corresponding to the at least one first boss, wherein the sole section comprises at least one sole aperture corresponding to the at least one second boss, wherein the head portion abuts the ledge, the midsection extends through the hollow interior, and the second plurality of threads engages the first plurality of threads, and wherein torqueing the head portion causes the end portion to move upwards within the first boss and the crown section to move toward the sole section.

In some embodiments, the midsection may comprise a structure selected from the group consisting of a solid rod, a hollow tube, and a spring. In other embodiments, the striking face may comprise a face center and an interior surface facing the hollow interior, and the at least one stiffening member may be disposed within 0.500 inch of the interior surface along a vertical plane extending through the face center perpendicular to the striking face. In still other embodiments, the golf club head may have a maximum vertical height, and the at least one stiffening member may have a length that is greater than the maximum vertical height. In any of these embodiments, when the striking face makes contact with a golf ball traveling at approximately 100 mph, the at least one stiffening member may comprise a first load value, the striking face may comprise a second load value, and the first load value may be at least 12% of the second load value.

Yet another aspect of the present invention is a golf club head comprising a body comprising a striking face, a sole section and a crown section, the body defining a hollow interior, at least one first boss comprising a bore with a ledge, at least one second boss comprising a bore with first a plurality of threads, and at least one stiffening member extending from the crown section to the sole section through the hollow interior, wherein the at least one stiffening member comprises a head portion, an end portion comprising a second plurality of threads, and a midsection connecting the head portion to the end portion, wherein the at least one stiffening member is disposed within 0.500 inch of an interior surface of the striking face, wherein the crown section comprises at least one crown aperture corresponding to the at least one first boss, wherein the sole section comprises at least one sole aperture corresponding to the at least one second boss, wherein the head portion abuts the ledge, the midsection extends through the hollow interior, and the second plurality of threads engages the first plurality of threads, and wherein torqueing the head portion causes the end portion to move downwards within the first boss and the sole section to move toward the crown section. In some embodiments, when the striking face makes contact with a golf ball traveling at approximately 100 mph, the at least one stiffening member may comprise a first load value, the striking face may comprise a second load value, and the first load value may be at least 30% of the second load value. In a further embodiment, the first load value may be at least 45% of the second load value.

Another aspect of the present invention is a golf club head comprising a body comprising a striking face, a sole section and a crown section, the body defining a hollow interior, and at least one adjustable length stiffening member extending from the crown section to the sole section through the hollow interior, wherein the at least one adjustable length stiffening member comprises a spoke and a cap, wherein the spoke comprises first and second threaded ends connected by a midsection, wherein the cap comprises an internally threaded counterbore, wherein the second threaded end engages the internally threaded counterbore, wherein the crown section comprises at least one crown aperture corresponding to the at least one adjustable length stiffening member, wherein the sole section comprises at least one sole aperture corresponding to the at least one adjustable length stiffening member, and wherein the midsection comprises a structure selected from the group consisting of a solid rod, a hollow tube, and a spring.

Yet another aspect of the present invention is a method comprising providing a golf club head body with a striking face, a sole section having at least one sole aperture corresponding with a first boss having a bore and an internal ledge, and a crown section having at least one crown aperture corresponding with a second boss having an internally threaded bore, the body defining a hollow interior and having a maximum vertical height, providing at least one stiffening member comprising a head portion, a midsection, a threaded end portion, and a length that is greater than the maximum vertical height, threading the threaded end of the stiffening member through the sole aperture and the hollow interior and engaging the threaded end with the threaded bore, torqueing the stiffening member until the head portion abuts the internal ledge and the at least one stiffening member has a desired preload value, and removing any portion of the stiffening member extending above the crown aperture. In some embodiments, the method may further comprise the step of permanently affixing the at least one stiffening member to the golf club head body via welding, brazing, soldering, or applying an adhesive material.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
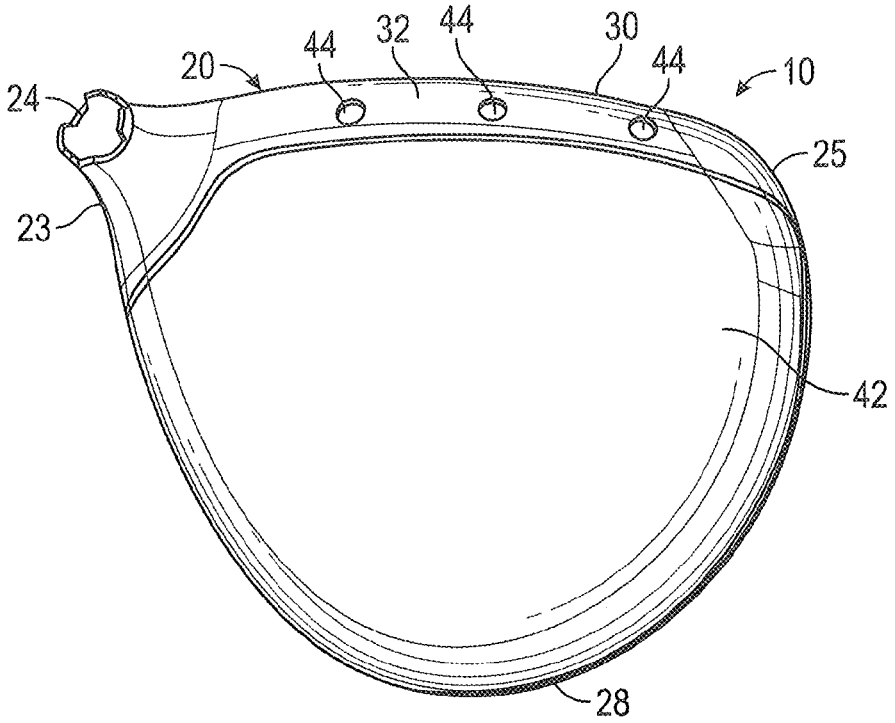
FIG. 1 is a top plan view of a first embodiment of the golf club head of the present invention.
Figure 2:
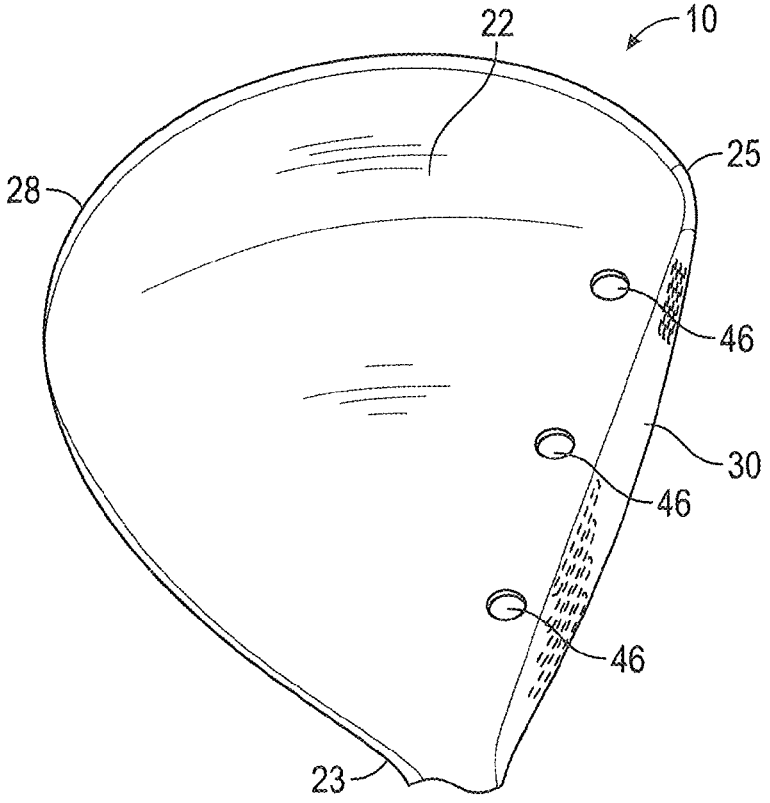
FIG. 2 is a sole perspective view of the golf club head shown in FIG. 1.

A preferred embodiment of the golf club head 10 of the present invention is shown in FIGS. 1-8 and 10-15. The golf club head 10 includes a body 20 having a sole section 22 that attaches to a lower edge of a striking face section 30, a return section 32 extending away from an upper edge of the striking face section 30, a hosel 24 for engaging a shaft, a heel end 23, a toe end 25, an upper opening 26, a hollow interior 27, and an aft end 28. A crown section 40 is comprised of the return section 32 and a crown insert 42 that is placed over the upper opening 26 to enclose the hollow interior 27. Within the hollow interior 27, multiple stiffening members 50 (preferably two to eight, and more preferably three or four) extend from the sole section 22 upward to the return section 32. In an alternative embodiment, the stiffening members 50 may extend to the crown insert 42 instead; what is important is that the stiffening members 50 connect the crown section 40 to the sole section 22 in close proximity to the striking face section 30.

Figure 3:
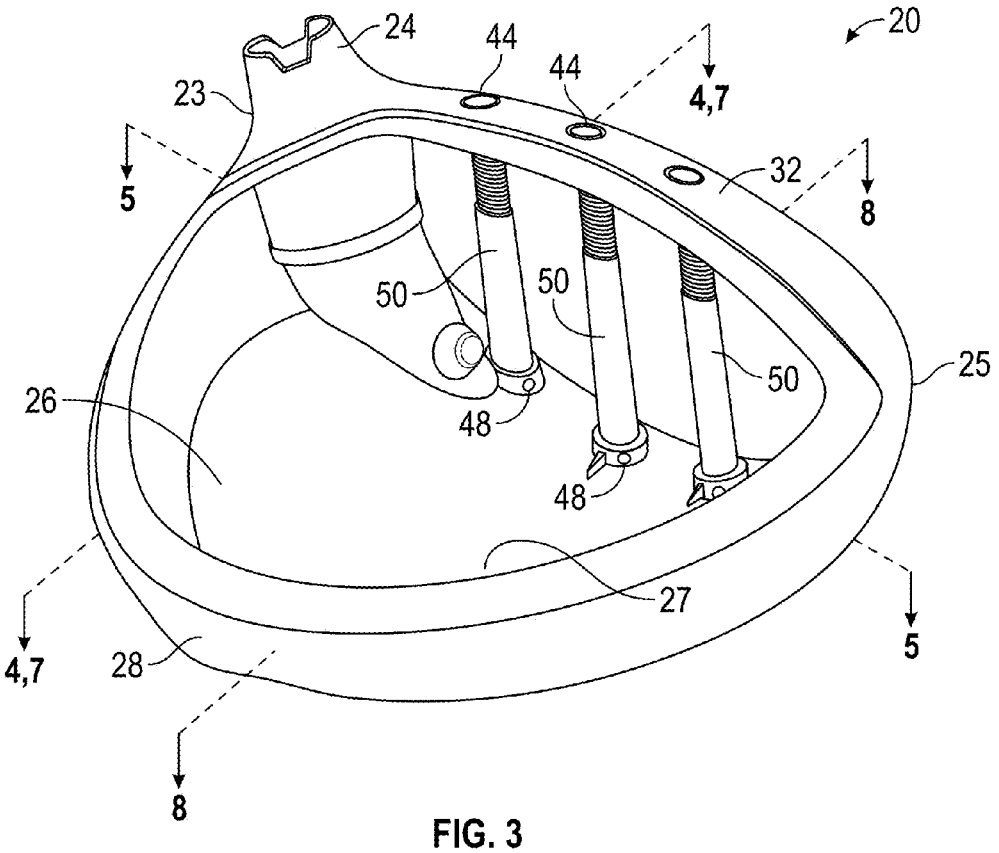
FIG. 3 is a top perspective view of the golf club head shown in FIG. 1 with the crown section removed to illustrate an interior.
Figure 16:
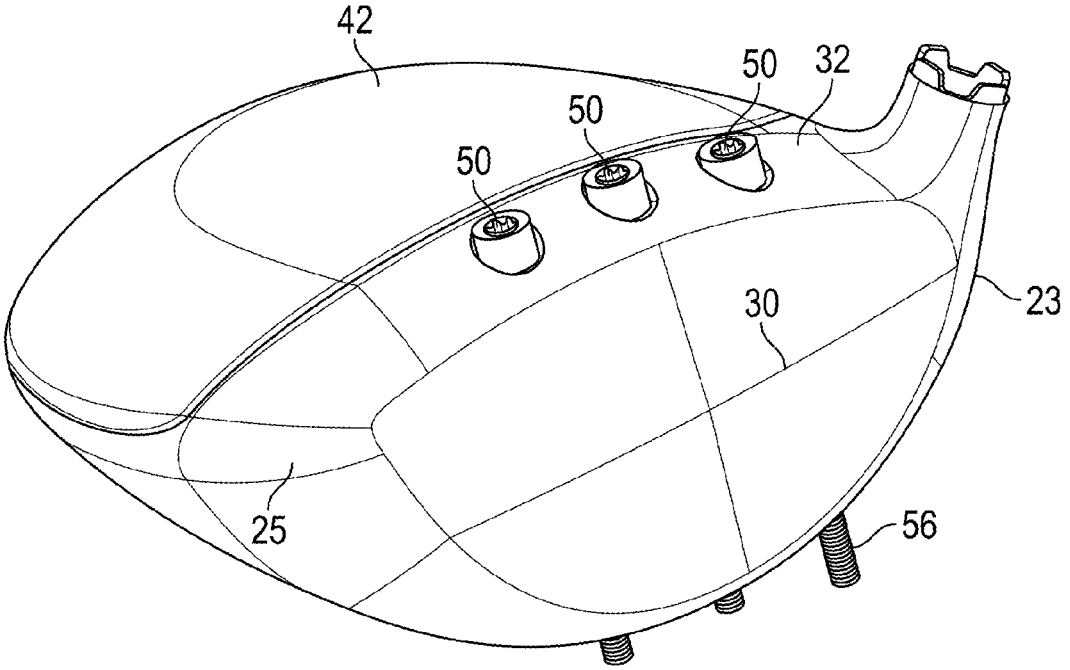
FIG. 16 is a front perspective view of another embodiment of the golf club head of the present invention.

As shown in FIG. 3, the preferred embodiment has three stiffening members 50. Each of the stiffening members 50 in the preferred embodiment comprises a midsection 52 composed of a solid, lightweight, strong metal material such as titanium alloy or steel, though in an alternative embodiment each midsection 52 of the stiffening members 50 may be hollow (e.g., a hollow tube) and be comprised of a strong, lightweight metal or a composite material. In yet another, alternative embodiment, the midsection 52 may comprise a spring structure. In another embodiment, the golf club head 10 may include one or more of the solid, hollow, and spring types of stiffening members 50. In the preferred embodiment, each of the stiffening members 50 has a head portion 54 and a threaded end portion 56 separated from the head portion 54 by the midsection 52, and has a diameter ranging from 0.050 inch to 0.200 inch. An exemplary stiffening member 50 is shown in FIG. 16. If any of the stiffening members 50 includes a hollow tube portion, that stiffening member preferably has a total mass that ranges from 0.5 gram to 3 grams, more preferably from 1 gram to 2 grams, and most preferably 1.5 grams.

The return section 32 (or in the alternative embodiment, the crown insert 42) preferably comprises a first plurality of apertures 44, each of which leads to a first, internally threaded boss 47 that extends downwards from the return section 32. Each of the first plurality of apertures 44, and each of the first, internally threaded bosses 47, preferably corresponds to one of the stiffening members 50. The sole section 22 comprises a second plurality of apertures 46, each of which leads to a second, unthreaded boss 48 that extends upwards from the sole section 22 into the hollow interior 27. Each of the plurality of second, unthreaded bosses 48 preferably corresponds to a stiffening member 50, and each of the unthreaded bosses 48 includes a ledge 49 which the head portion 54 of the stiffening member 50 abuts and presses against when the stiffening member 50 is torqued within the golf club head 10.

Figure 10:
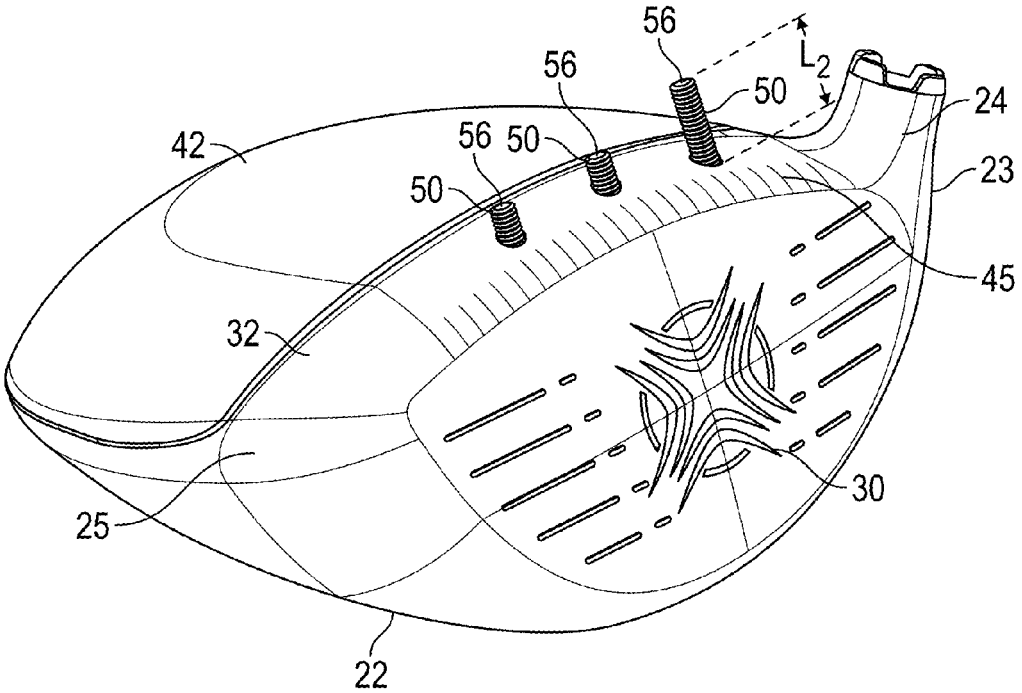
FIG. 10 is a side perspective view of the golf club head shown in FIG. 1 with the stiffening members protruding from the apertures in the return section.
Figure 11:
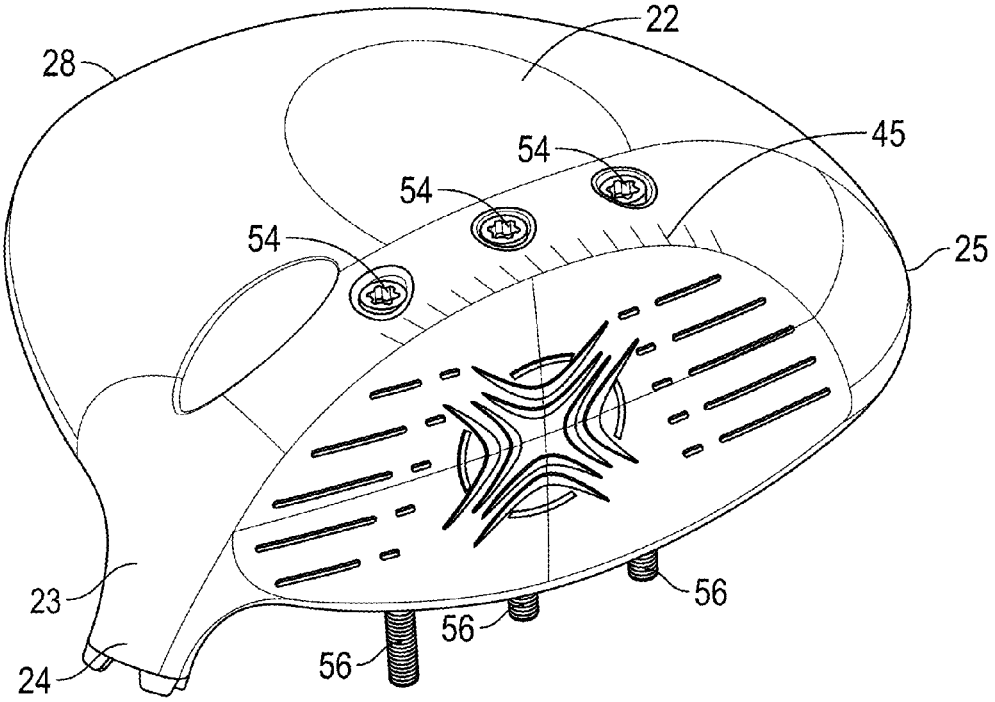
FIG. 11 is a sole perspective view of the golf club head shown in FIG. 10.
Figure 12:
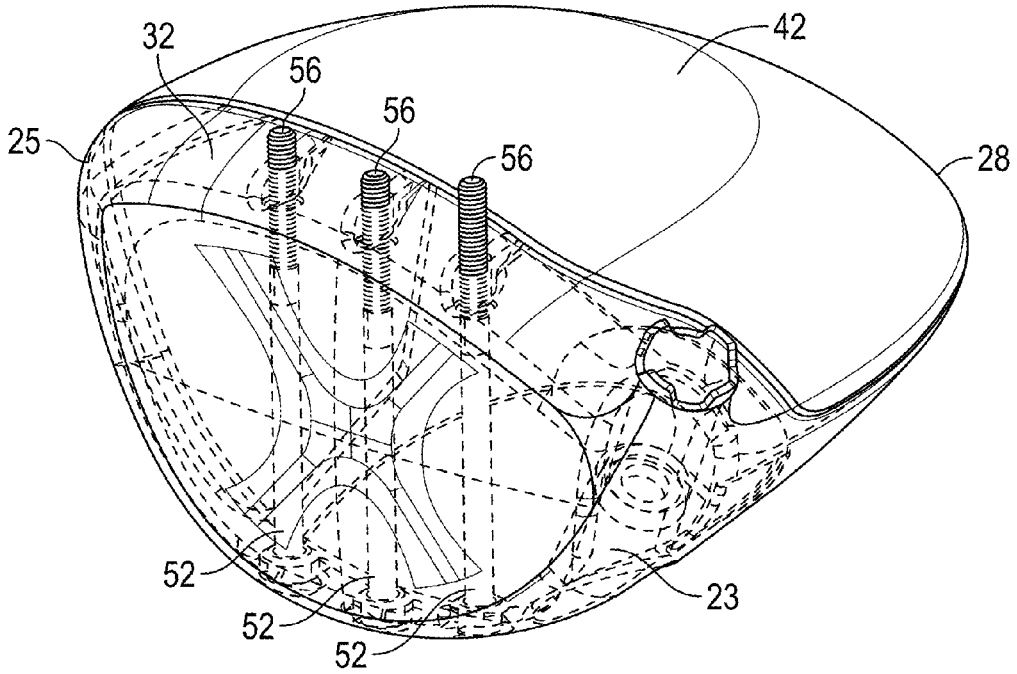
FIG. 12 is a front, partially transparent, perspective view of the golf club head shown in FIG. 10.
Figure 13:
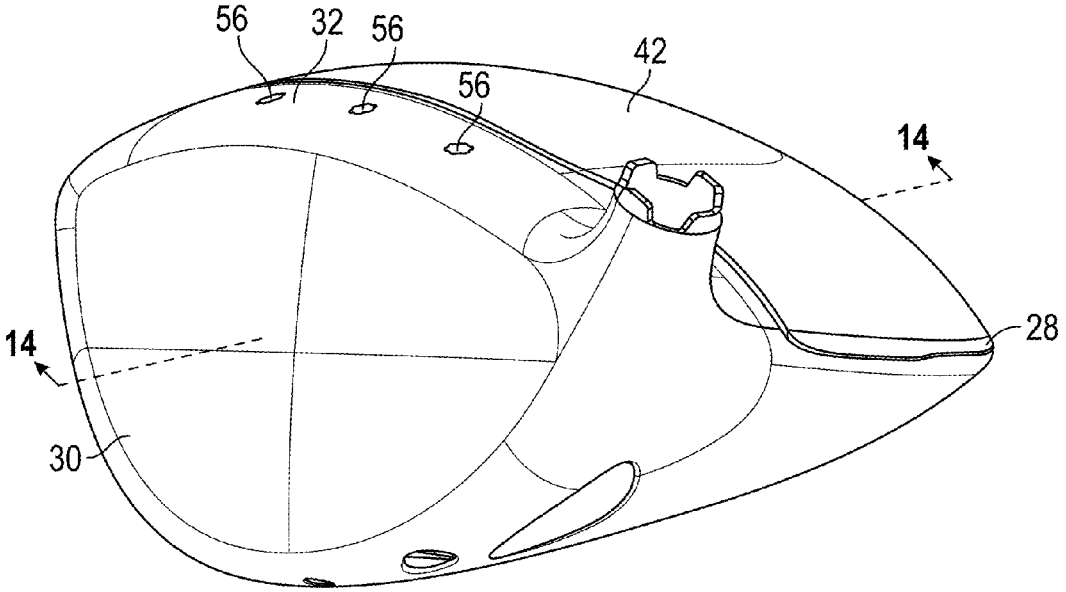
FIG. 13 is a front perspective view of the golf club head shown in FIG. 10 after excess stiffening material has been removed.
Figure 14:
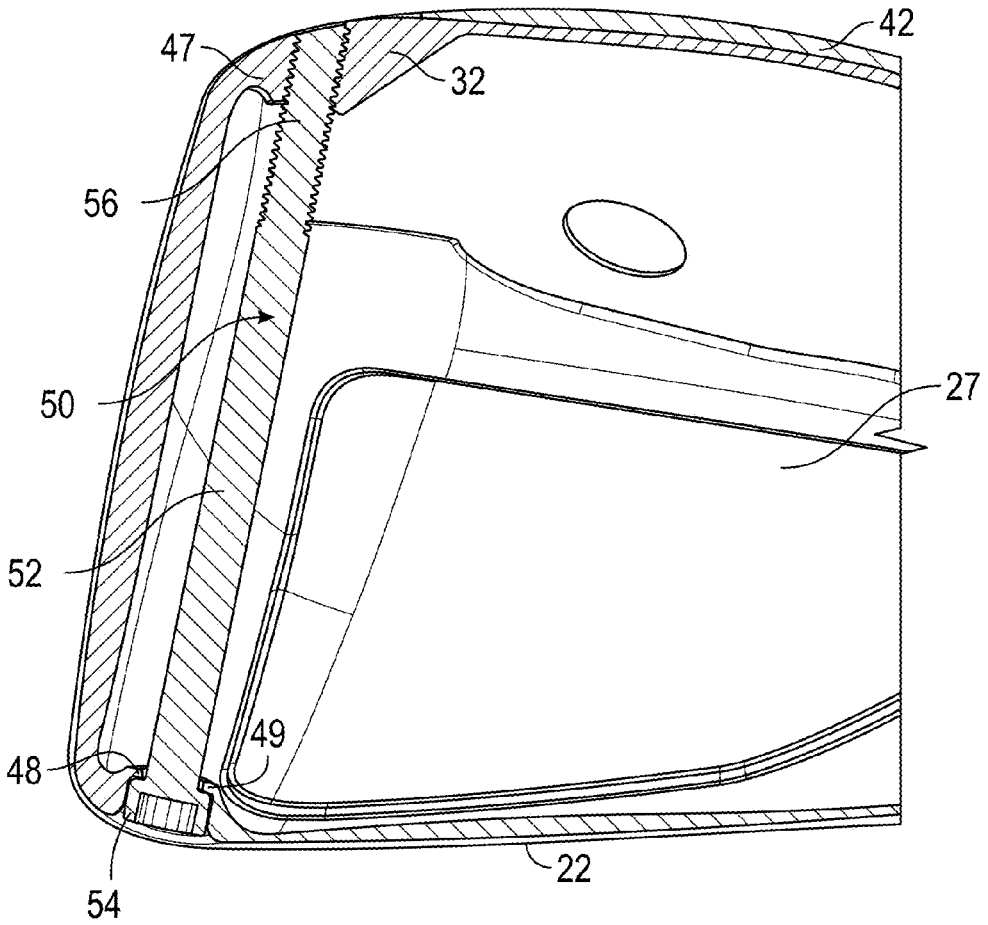
FIG. 14 is a cross-sectional view of the golf club head shown in FIG. 13 along lines 14-14.
Figure 15:
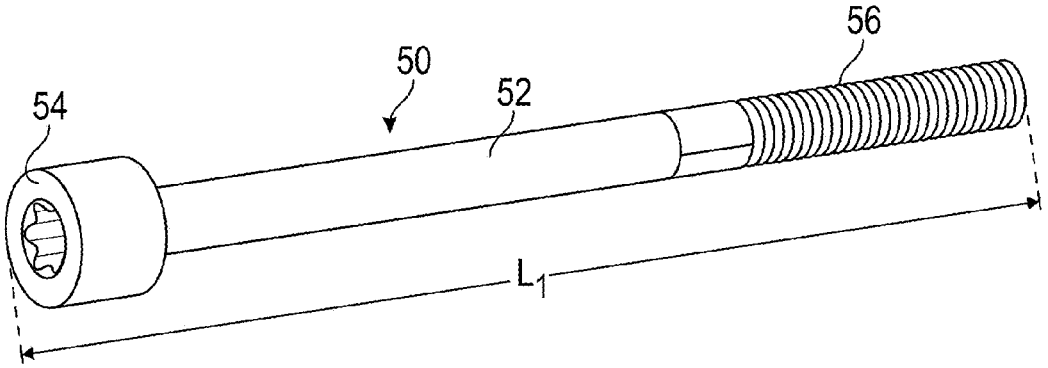
FIG. 15 is a side elevational view of a stiffening member of the present invention.
Figure 17:
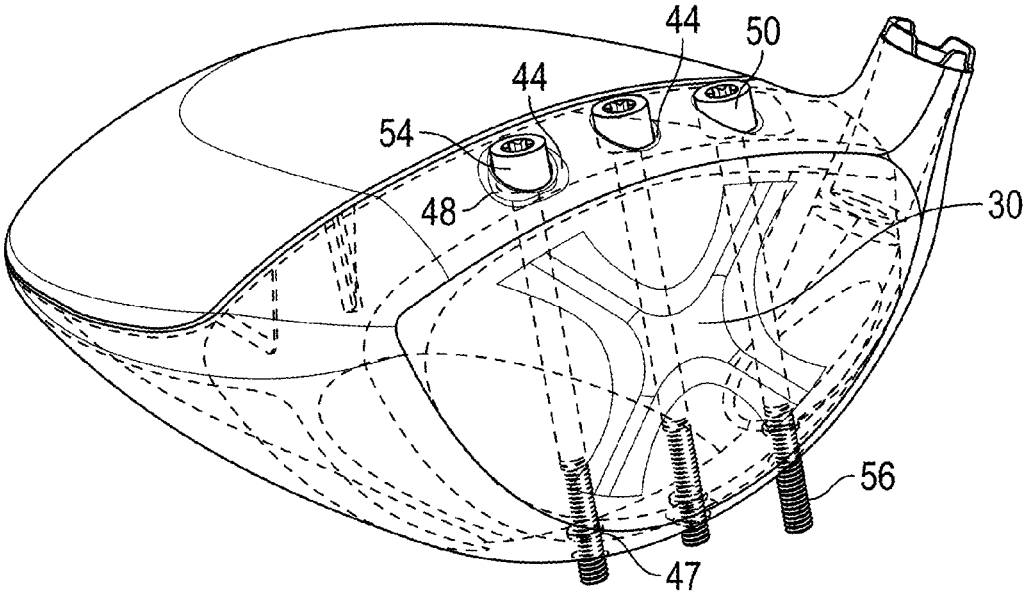
FIG. 17 is a partially transparent view of the embodiment shown in FIG. 16.
Figure 18:
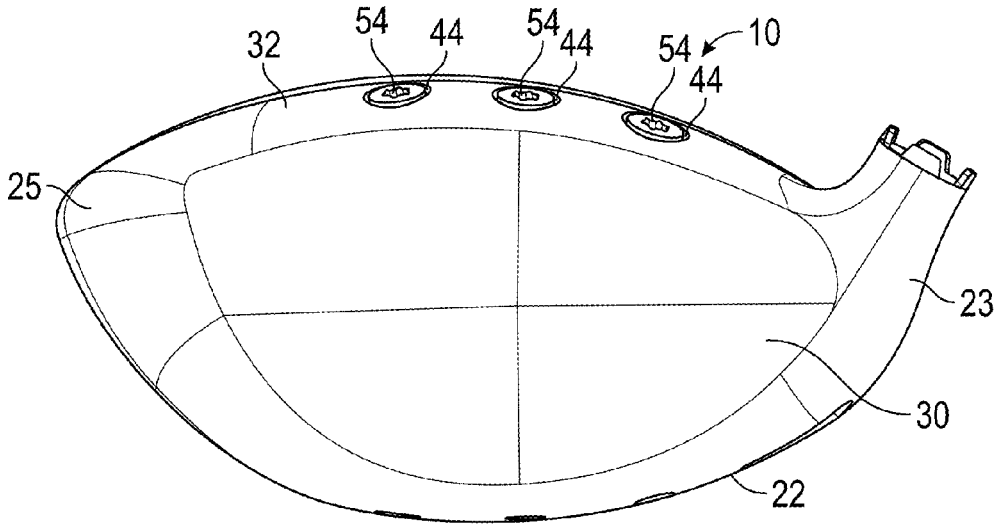
FIG. 18 is a front elevational view of the embodiment shown in FIG. 16/

As shown in FIGS. 10-12, each of the stiffening members 50 preferably has a length $L_1$ that is greater than the greatest vertical height H of the golf club head 10. Each stiffening member 50 is inserted into an aperture 46 in the sole section 22 and pushed through the hollow interior 27 of the golf club head 10 so that the head portion 54 abuts the ledge 49 and the threaded end portion 56 engages the internally threaded boss 47 located directly above the aperture 46 into which the stiffening member 50 was inserted. In an alternative embodiment, shown in FIGS. 16-18, the threading is reversed, such that the apertures 44 in the return section 32 lead to the unthreaded boss 48 with the ledge 49 and the apertures 46 in the sole section lead to the internally threaded boss 47, and the stiffening members 50 are inserted into the golf club head 10 via the apertures 44 in the return section 32. In yet another alternative embodiment, shown in FIG. 19, the stiffening members 50 are made of two pieces, a spoke 80 with two threaded ends 82, 84 on either side of a midsection 83, and a cap 85 with a threaded counterbore 87. This construction allows a user to adjust the overall length $L_1$ of the stiffening members 50 by controlling how far into the threaded counterbore 87 the spoke 80 extends, and can be used in either of the golf club head 10 embodiments discussed above and shown in FIGS. 10-18. The midsection 83 of the spoke 80 may include a hollow tube, a solid rod, or a spring structure.

Figure 9:
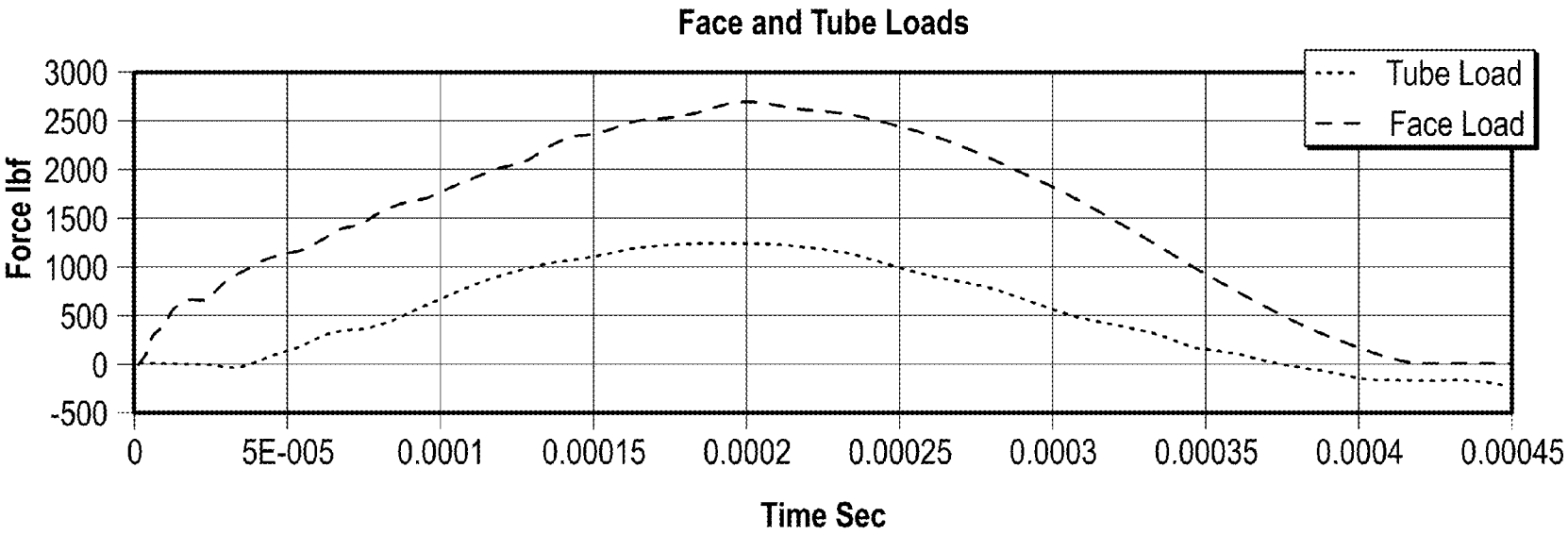
FIG. 9 is a chart illustrating the load placed on the striking face section and the stiffening members during a 100 mph impact with a golf ball.

Regardless of how the stiffening members 50 are assembled or inserted into the golf club head 10, the threading in each internally threaded boss 47 allows the stiffening member 50 to which it corresponds to be preloaded in the golf club head 10. Preloading is accomplished using a tool, such as a torque wrench or a screwdriver, which engages the head portion 54 of the stiffening member 50 to torque the stiffening member 50 such that the threaded end portion 56 engages the threads of the internally threaded boss 47 and pulls the return section 32 towards the sole section 22. Preloading each stiffening member 50 reduces the peak stress placed on the striking face section 30 when the golf club head 10 impacts a golf ball 100, and thereby reduces the risk that the striking face section 30 will crack under impact load. When all of the stiffening members 50 are preloaded as described above, the peak stress placed on the region 45 of the body 20 located between the stiffening members 50 and the striking face section during impact with a golf ball 100 is also lowered. In other words, preloading improves the resilience of the golf club head 10 during impact with a golf ball 100 by distributing the stresses more evenly. In order to achieve these desirable results, it is preferable to torque the stiffening members 50 so they collectively have a load value of at least 375 lbf, or at least 12% of the load value placed on the striking face section 30, more preferably at least 1250 lbf, or at least 30% of the load value placed on the striking face section 30, and most preferably at least 45% of the load value placed on the striking face section 30 (e.g., at least 2750 lbf) when it makes contact with a golf ball 100 at approximately 100 mph, as shown in FIG. 9. Individually, each stiffening member 50 preferably should be preloaded to a range of 125-1000 lbf to achieve this result.

Figure 19:
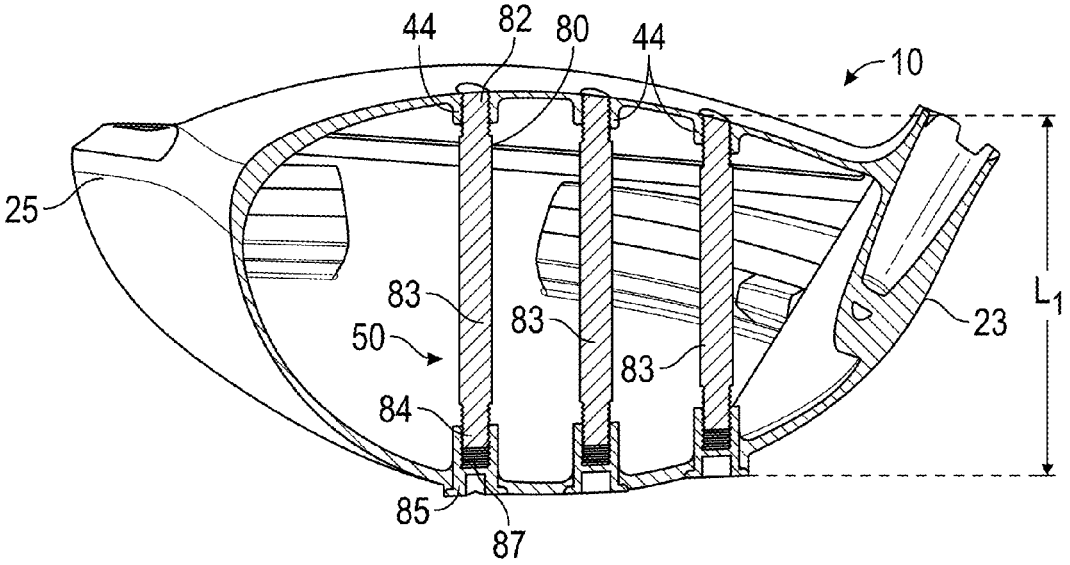
FIG. 19 is a front elevational view of another embodiment of the golf club head of the present invention with the striking face section removed.

Once the stiffening members 50 are preloaded to a desired load value, any excess length $L_2$ extending through the apertures 44 in the return section 32 is removed by any means known to a person of ordinary skill in the art, including but not limited to machining. This step can be bypassed if the adjustable length stiffening members 50 shown in FIG. 19 are used. The stiffening members 50 can then be permanently affixed to the golf club head via welding, brazing, or soldering, or with an adhesive such as Loctite®, though this step is not required and can be bypassed if a golfer wants to retain the ability to adjust the load placed on the stiffening members 50.

Figure 4:
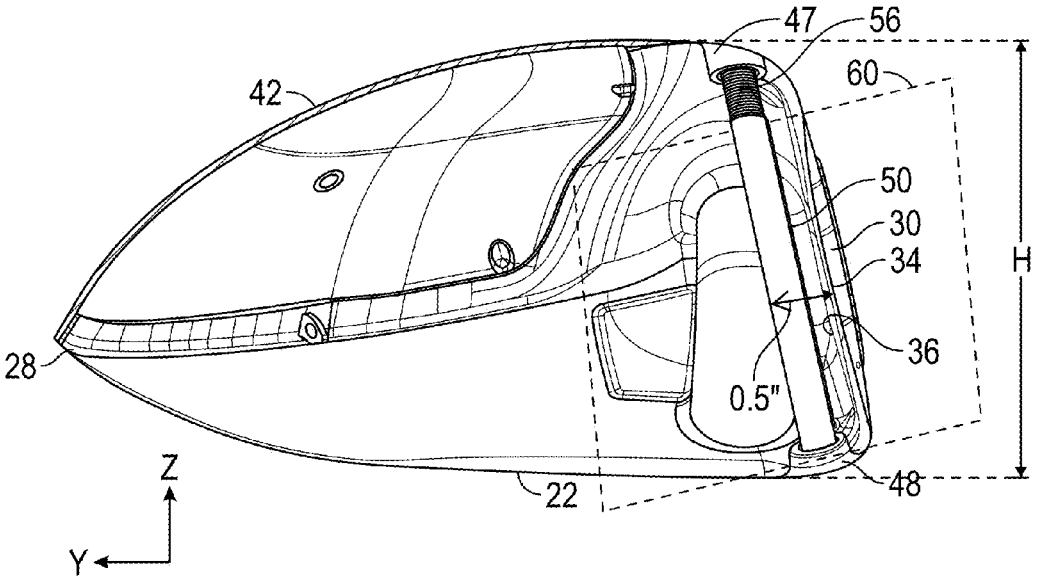
FIG. 4 is a cross-sectional view of the golf club head shown in FIG. 3 along lines 4-4.
Figure 5:
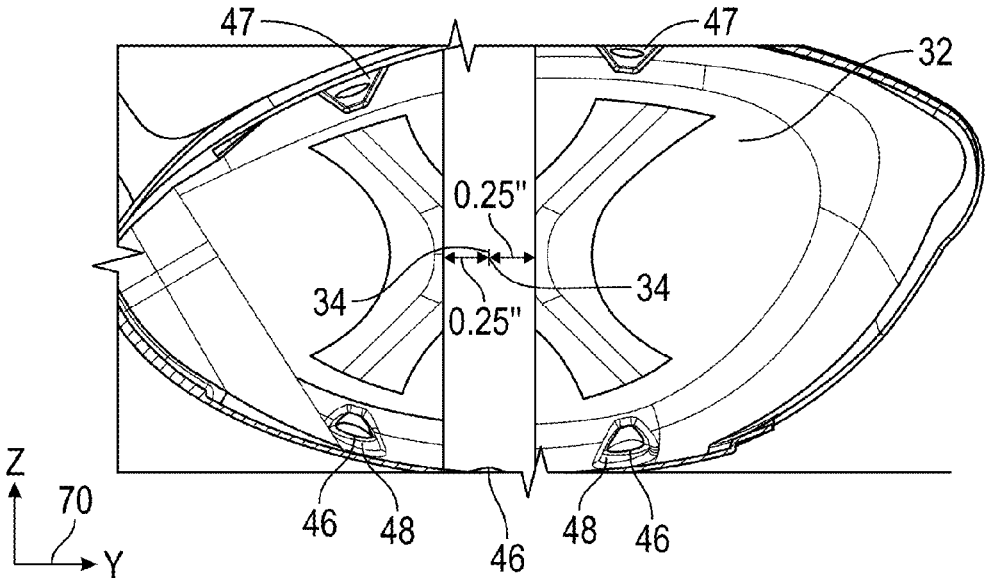
FIG. 5 is a cross-sectional view of the golf club head shown in FIG. 3 along lines 5-5 without the tubes.
Figure 6:
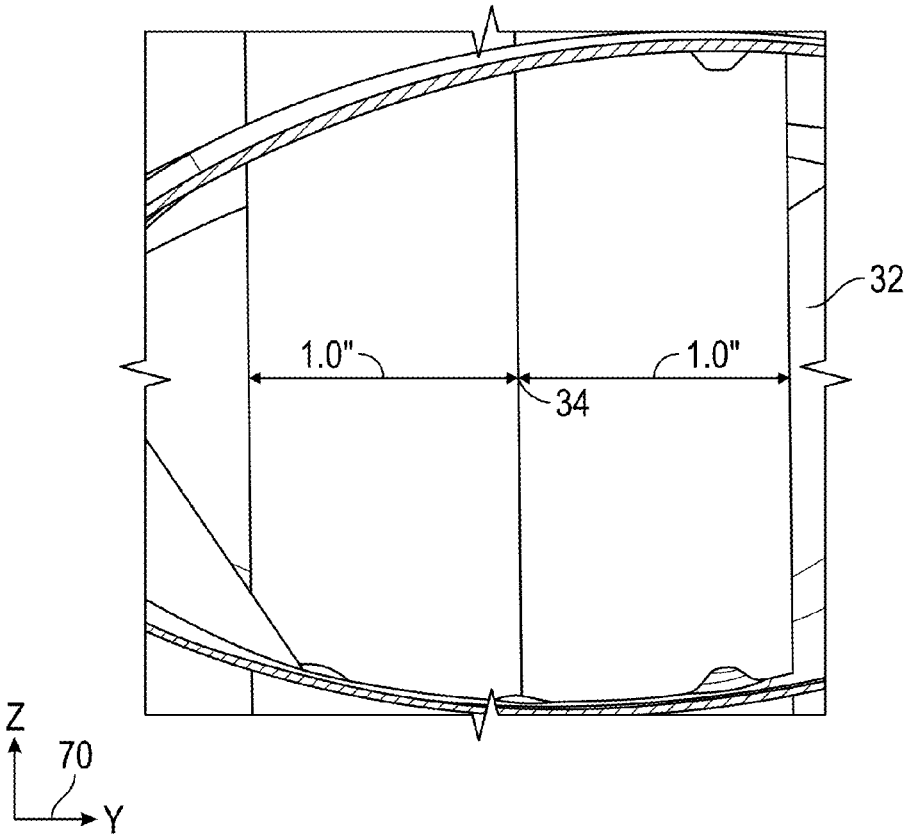
FIG. 6 is another view of the embodiment shown in FIG. 5.
Figure 7:
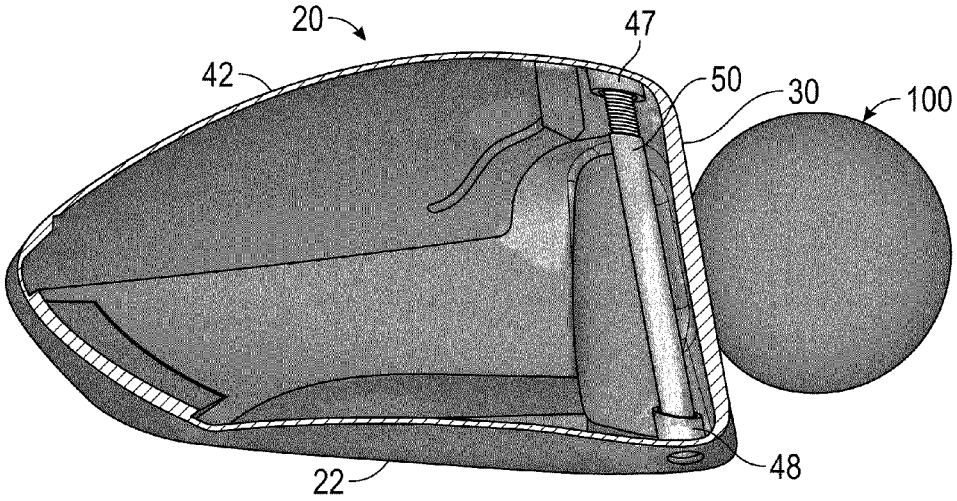
FIG. 7 is a cross-sectional view of the golf club head shown in FIG. 3 along lines 7-7 at impact with a golf ball, with stress illustrated via shading.
Figure 8:
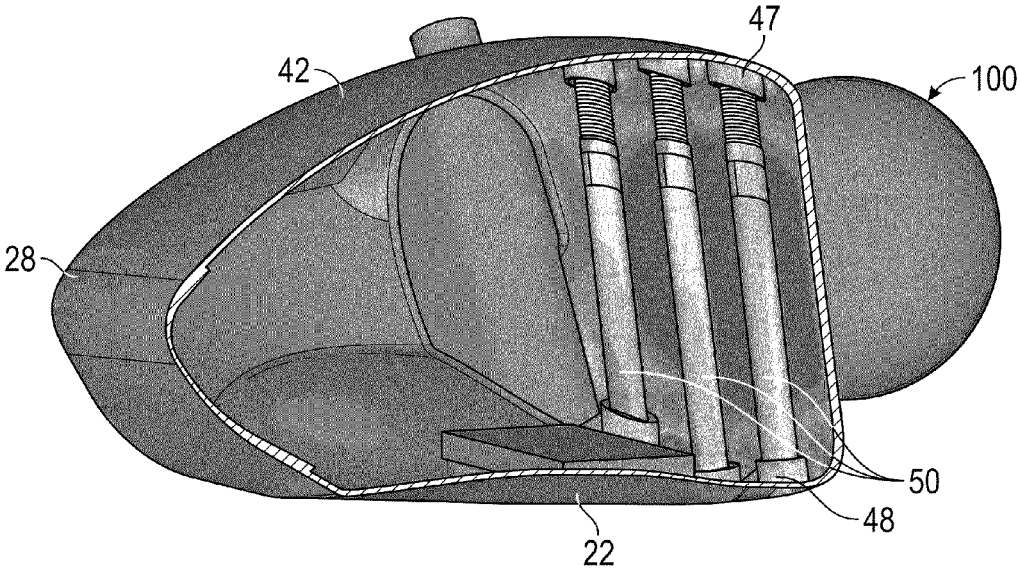
FIG. 8 is a cross-sectional view of the golf club head shown in FIG. 3 along lines 8-8 at impact with a golf ball, with stress illustrated via shading.

As shown in FIG. 4, in each of the embodiments disclosed herein, each stiffening member 50 preferably is located less than 0.500 inch from the interior surface 36 of the striking face section 30, measured along a vertical plane 60 extending through the face center 34 perpendicular to the striking face section 30. No portion of any stiffening member 50 should be disposed outside of this 0.500 inch range. As shown in FIG. 5, the middle stiffening member 50 preferably is disposed within 0.250 inch, toe-wards or heel-wards, of the face center 34 along a horizontal Y-axis 70 extending parallel to the striking face section 30. The other two stiffening members 50 preferably are each disposed within 1 inch, toe-wards and heel-wards, of the face center 34 along the horizontal Y-axis 70.

Locating the stiffening members 50 within the region of the golf club head 10 defined above and in FIGS. 4 and 5 has the greatest stress-reducing effect on the golf club head 10. If any of the stiffening members 50 are placed more than 0.500 inch away from the interior surface 36 of the striking face section 30 or outside of the 0.250/1 inch range, they will not have a noticeable effect on the stress placed on the striking face section 30 when the golf club head 10 is in use, and will use up discretionary mass without creating a significant performance benefit.

In each of the embodiments disclosed herein, the golf club head 10 preferably has a characteristic time (CT) of the face close to, but not exceeding, the 257 microsecond ("μS") limit set by the USGA.

The stiffening members of the present invention may be used as described herein in any type of golf club head with a hollow interior, including putters, irons, wedges, hybrids, fairway woods, and drivers. In any of the embodiments disclosed herein, when the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In fact, in the preferred embodiment, the golf club head 10 has a volume of approximately 450 cc to 460 cc.

The volume of the golf club head 10 will also vary between fairway woods (preferably ranging from 3-woods to eleven woods) with smaller volumes than drivers. When designed as a driver, the golf club head 10 preferably has a mass no more than 215 grams, and most preferably a mass of 180 to 215 grams; when designed as a fairway wood, the golf club head 10 preferably has a mass of 135 grams to 200 grams, and preferably from 140 grams to 165 grams.

In each of the embodiments disclosed herein, the striking face section 30 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the face section has a uniform thickness.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body 20 using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face, a sole section extending from a lower edge of the striking face, a return section extending from an upper edge of the striking face, and an upper opening, the return section disposed between the striking face and the upper opening;

a crown section affixed to the body to close the upper opening and define a hollow interior;

at least one first boss extending from the return section into the hollow interior and comprising a first through-bore with a first plurality of threads, the first through-bore in communication with at least one return aperture disposed in the return section;

at least one second boss extending from the sole section into the hollow interior and comprising a second through-bore surrounded by a ledge, the second through-bore in communication with at least one sole aperture disposed in the sole section; and at least one stiffening member comprising a head portion, an end portion comprising a second plurality of threads sized to mate with the first plurality of threads, and a midsection connecting the head portion to the end portion, wherein the striking face comprises a face center and an interior surface facing the hollow interior, wherein the at least one stiffening member is engaged with the body so that the head portion abuts the ledge, the midsection extends through the second through-bore and hollow interior, and the end portion is received within the first through-bore so that the second plurality of threads engages the first plurality of threads, wherein the at least one stiffening member is entirely disposed within 0.500 inch of the interior surface along a vertical plane extending through the face center perpendicular to the striking face, wherein the at least one stiffening member is at least partially composed of a metal alloy, and wherein torqueing the head portion with a tool causes the end portion to move upwards within the first boss away from the sole section and the return section to move toward the sole section and reduces peak stress placed on the striking face section when the striking face section impacts a golf ball.

2. The golf club head of claim 1, wherein the midsection comprises a structure selected from the group consisting of a solid rod, a hollow tube, and a spring.

3. The golf club head of claim 1, wherein the golf club head has a maximum vertical height, and wherein the at least one stiffening member has a length that is greater than the maximum vertical height.

4. The golf club head of claim 1, wherein the at least one stiffening member has a diameter ranging from 0.050 inch to 0.200 inch.

5. The golf club head of claim 1, wherein the at least one stiffening member has a mass ranging from 0.5 gram to 3.0 grams.

6. The golf club head of claim 1, wherein the golf club head has a characteristic time of no greater than 257 microseconds.

7. The golf club head of claim 1, wherein the at least one stiffening member comprises three stiffening members.

* * * * *